US009557755B2

(12) United States Patent
Ahrendt

(10) Patent No.: US 9,557,755 B2
(45) Date of Patent: Jan. 31, 2017

(54) INTERFACE CIRCUIT FOR A HEARING AID AND METHOD

(71) Applicant: GN ReSound A/S, Ballerup (DK)

(72) Inventor: Henrik Ahrendt, Solrod Strand (DK)

(73) Assignee: GN RESOUND A/S, Ballerup (DK)

( * ) Notice: Subject to any disclaimer, the term of this patent is extended or adjusted under 35 U.S.C. 154(b) by 185 days.

(21) Appl. No.: 14/308,509

(22) Filed: Jun. 18, 2014

(65) Prior Publication Data

US 2015/0362932 A1 Dec. 17, 2015

(30) Foreign Application Priority Data

Jun. 13, 2014 (DK) ..... 2014 70355
Jun. 13, 2014 (EP) ..... 14172394

(51) Int. Cl.
*G05F 1/46* (2006.01)
*H04R 25/00* (2006.01)

(52) U.S. Cl.
CPC ..... *G05F 1/46* (2013.01); *H04R 25/505* (2013.01); *H04R 2460/03* (2013.01)

(58) Field of Classification Search
CPC ..... H04R 25/00
USPC ..... 381/94.1, 312, 313
See application file for complete search history.

(56) References Cited

U.S. PATENT DOCUMENTS 5,448,198 A * 9/1995 Toyoshima ..... H01L 27/0218 257/E27.11
6,087,852 A 7/2000 Briggs et al.
6,333,571 B1 12/2001 Teraoka et al.
2006/0023519 A1 2/2006 Choi et al.
2010/0259465 A1 10/2010 Chang
2011/0211717 A1* 9/2011 Hoevesteen ..... H04R 25/505 381/323
2012/0121106 A1* 5/2012 Henriksen ..... H03F 1/3211 381/94.1
2012/0280740 A1 11/2012 Uno

OTHER PUBLICATIONS

First Technical Examination and Search Report dated Jan. 19, 2015, for corresponding Danish Patent Application No. PA 2014 70355, 6 pages.
Extended European Search Report dated Aug. 19, 2014, for related EP Patent Application No. 14172394.0, 6 pages.

* cited by examiner

*Primary Examiner* — Duc Nguyen
*Assistant Examiner* — Phan Le
(74) *Attorney, Agent, or Firm* — Vista IP Law Group, LLP

(57) ABSTRACT

An interface pad circuit configured for conveying an electrical signal from a semiconductor chip component to a component external to the semiconductor chip component, the interface pad circuit includes: a control circuit; a plurality of semiconductor elements, the semiconductor elements having respective bulk terminals and being controlled by the control circuit; and a connection pad; wherein at least two of the semiconductor elements are configured for providing a plurality of non-zero logic voltage levels to the connection pad; and wherein the control circuit is configured to apply a voltage level to the bulk terminals of the at least two of the semiconductor elements providing the non-zero logic voltage levels, the voltage level applied by the control circuit corresponding to the highest voltage level of the plurality of non-zero logic voltage levels.

15 Claims, 3 Drawing Sheets

INTERFACE CIRCUIT FOR A HEARING AID AND METHOD

RELATED APPLICATION DATA

This application claims priority to, and the benefit of, Danish Patent Application No. PA 2014 70355, filed on Jun. 13, 2014, pending, and European Patent Application No. 14172394.0, filed Jun. 13, 2014, pending. The entire disclosures of both of the above applications are expressly incorporated by reference herein.

FIELD

This disclosure relates to hearing aids. More specific, it relates to hearing aids comprising multiple integrated electronic circuits.

BACKGROUND

A contemporary hearing aid comprises electronic circuits of very large scale integration in order to accommodate the circuits necessary to perform the desired functionality of the hearing aid while keeping the physical size of the hearing aid as small as possible. This means that the chip or die containing the semiconductor components of the hearing aid also has to be as small as possible in order to fit within the hearing aid housing. At the same time the circuit needs to be optimized to use as little power as possible in order to prolong the life of the battery powering the hearing aid.

Due to a number of practical issues, it is often necessary to distribute the circuit on several silicon dies and provide interconnections between the parts of the circuit residing on different silicon dies or chips, e.g. in the form of bonded electrical connections from one chip to another. Interface terminations for these bondings are provided on each chip as larger, metalized areas denoted pads. During assembly, the pads of different chips on the same substrate are interconnected by bonding wires, e.g. by soldering or ultrasound-welding the bonding wires to the pads forming electrical connections between the wire ends and the pads. The wires and the pads used in the assembly process are usually made from gold or other noble metals resistant to corrosion. Transferring digital signals reliably between individual chips usually consumes a lot of power on the chip, mainly because of the parasitic capacitance introduced by the interfacing pads and the associated components and connections. Since the semiconductor elements present on the chips are typically MOSFET transistors sensitive to electrostatic discharges (ESD), the inclusion of special ESD protection circuits are also mandatory when connecting chips to other chips or to peripheral components. However, the ESD protection circuits also contribute to the parasitic capacitance of the interface pad circuit.

SUMMARY

A digital hearing aid circuit may beneficially be capable of operating at more than one logic voltage level, e.g. during a power-on reset event, where the pads may temporarily provide electrical communication at a higher initial logic voltage level than the logic voltage level used for nominal operation. When all parts of the circuit is operating nominally, the voltage level provided by the pads may beneficially be lowered, e.g. to half the voltage of the initial voltage level. Thus, the interfacing pads have to be capable of conveying these voltages to the circuits connected thereto whenever needed. Logic voltage levels for hearing aid circuits may range from 0.5 volts to approximately 3 volts.

An interface pad circuit adapted for conveying an electrical signal from a semiconductor chip component to a component external to the semiconductor chip component is devised, the interface pad circuit comprising a control circuit, a plurality of semiconductor elements and a connection pad, each semiconductor element of the plurality of semiconductor elements having a bulk terminal and being controlled by the control circuit and adapted for providing a logic zero voltage level and a plurality of specific, non-zero logic voltage levels to the connection pad, wherein the highest voltage level of the plurality of the provided logic voltage levels is applied to the bulk terminal of each of the semiconductor elements providing the non-zero logic voltage levels.

This configuration gives the chip an enhanced drive strength and the capability of providing a plurality of different, non-zero logic voltage levels. In one or more embodiments of the interface pad circuit, a set of three semiconductor elements in the form of MOSFET transistors is controlled by a logic control circuit in order to provide either a higher voltage level or a lower voltage level to the interface pad according to requirements. A first PMOS transistor controls the higher voltage level, an NMOS transistor controls the logic "zero" voltage level (i.e. 0 volts), and a second PMOS transistor controls the lower voltage level. The NMOS transistor and the first PMOS transistor both have their bulk terminals permanently connected to their respective source terminals in order to preserve the threshold capabilities of the transistors. However, the second PMOS transistor has its bulk terminal connected to the higher voltage level. All three transistors have their drain terminals connected to the pad output terminal in order to provide the desired logic voltage to external components connected thereto.

If the second PMOS transistor providing the lower voltage level were to have its bulk terminal connected to its source terminal in a fashion similar to the first PMOS transistor, this configuration would lead to a situation where the drain-bulk diode present in the second PMOS transistor would conduct a current whenever the first PMOS transistor was turned on and the second PMOS transistor was turned off due to the voltage difference between the lower and the higher voltage levels exceeding the threshold voltage $V_T$ of the second PMOS transistor. Therefore, the bulk terminal of the second PMOS transistor needs to be connected to the higher voltage in order for the voltage difference between the drain and bulk terminals to be smaller than the threshold voltage. However, this arrangement leads to a degradation of the threshold voltage of the second PMOS transistor.

In order to counteract the degradation of the threshold of the second PMOS transistor following from the higher bulk voltage potential, this embodiment needs to utilize a specially designed PMOS transistor due to the fact that the bulk voltage is now higher than the source voltage of the transistor. When the threshold of the second PMOS transistor is degraded, the transistor has to be made physically much wider (up to fifteen times wider in worst cases) in order to keep the drain-source on-resistance $R_{DS}$ of the transistor below its maximum allowable value.

The dynamic power requirement of a switching circuit is given by:

$$P_{dyn}=V^2 \cdot f \cdot c \quad (1)$$

Here V denotes a logic "1" voltage level, f is the switching frequency and C is the capacitance of the switching circuit.

In this context, the term 'circuit' may cover single semiconductor elements as well as large, complex circuits. From equation (1) it will be obvious that the voltage level V should be as low as possible in order to minimize the dynamic power dissipation in a transistor since the dynamic power increases with the voltage squared. In other words, since both the capacitance of the second PMOS transistor is larger due to the larger physical width and the threshold voltage $V_T$ is higher than the nominal voltage of the rest of the hearing aid circuit, as discussed in the foregoing, this design ends up taking up more space on the chip and costing a lot of dynamic power.

If the drain-source on-resistance of the second PMOS transistor is too high it will put a limitation on the current that can be provided by the transistor, and consequently, the drive strength of the interface pad circuit will be too low. In this embodiment, this may only be alleviated by utilizing a wider transistor design at the cost of an increase in the area used on the chip by the transistor and an increase in dynamic power due to the larger parasitic and gate capacitances as a consequence of using the physically larger transistor.

Thus, a need exists for an interface pad circuit design where these problems are reduced or eliminated. In order to keep the dynamic power requirement of the interface circuit pad low, an alternative embodiment capable of utilizing a smaller transistor design is described in the following.

Further, an interface pad circuit is devised, said interface pad circuit further having the control circuit adapted for selectively providing one of the plurality of non-zero logic voltages to the bulk terminal of each one of the semiconductor elements, wherein at least one of the voltages provided to the bulk terminal of a particular semiconductor element is substantially equal to the logic voltage level provided by that particular semiconductor element, and at least another of the voltages provided to the bulk terminal of the same semiconductor element is substantially equal to the highest logic voltage level provided by any semiconductor element feeding the interface pad.

As used in this specification, the term "substantially equal" or similar terms, such as "substantially the same", etc., refers to two items that do not differ by more than 10%. For example, if a voltage or voltage level is described as being "substantially equal to" or "substantially the same as" another voltage or voltage level, that means the two voltages or the two voltage levels do not differ by more than 10% (e.g., the two voltages or voltage levels may differ by 9%, 5%, 3%, 1%, may be equal, etc.).

In this interface pad circuit, the bulk terminal of each semiconductor element is thus provided with one of two bulk biasing voltages. If the semiconductor elements are embodied as MOS transistors, the drain-bulk diode of the MOS transistors remains closed when the bulk bias voltage is applied, i.e. no excess current is drawn, and the on-resistance $R_{DS}$ of the MOS transistors remains sufficiently low, thus eliminating the need to utilize a wider transistor. This allows for smaller transistor devices to be used for providing the desired logic voltage levels on the chip while maintaining the desired drive strength of the output pad. As stated in the foregoing, a smaller MOS transistor also has the added benefit of a smaller inherent capacitance and therefore a lower dynamic power requirement.

In an exemplary interface pad circuit, the control circuit is adapted to apply the non-zero logic voltage level being substantially equal to the voltage level provided by a particular semiconductor element to the bulk terminal of that particular semiconductor element when that particular semiconductor element is providing its associated non-zero logic voltage level to the interface pad, and to apply the highest logic voltage level provided by any semiconductor element feeding the interface pad to the bulk terminal of the particular semiconductor element when any other semiconductor element of the interface pad is providing its logic voltage level to the interface pad.

This embodiment allows for an arbitrary number of non-zero logic voltage levels to be provided by the interface pad circuit while maintaining high drive strength, low dynamic power consumption and a modest physical space requirement on the silicon chip.

The subject disclosure also relates to a method of operating an interface pad of a microelectronic integrated circuit, said method involving the steps of providing the microelectronic circuit, said circuit comprising a plurality of semiconductor elements each controlling a logic voltage level, wherein each semiconductor element of the plurality of semiconductor elements is provided with one of two bulk biasing voltages, the first bulk biasing voltage being substantially equal to the logic voltage level provided by that particular semiconductor element, and the second bulk biasing voltage being substantially equal to the highest logic voltage level provided by any semiconductor of the interface pad, and wherein the first of the two bulk biasing voltages is provided to the bulk terminal of the particular semiconductor element when that particular semiconductor element is controlling the logic voltage level corresponding to that semiconductor, and the second of the two bulk biasing voltages is provided to the bulk terminal of the particular semiconductor element when any other semiconductor element of the interface pad is controlling the logic voltage level corresponding to the other semiconductor.

Thus, a method of operating an interface pad of a microelectronic circuit is devised, enabling the interface pad to drive inputs on other microelectronic circuits at a plurality of logic voltage levels by controlling the bulk biasing voltage to each semiconductor. The method is therefore of particular interest in operating electronic circuits in hearing aids. By providing each semiconductor element with a selection of two different bulk biasing voltages, leakage current of the particular semiconductor element may thus be minimized when the interface pad is configured to provide logic voltages different from the logic voltage provided by that particular semiconductor element. Each semiconductor element of the interface pad may also be made smaller as a consequence of this arrangement, thus reducing the dynamic power requirements of the interface pad. The method is of particular relevance to interface pads of microelectronic circuits intended for use in hearing aids, where physical space and available power are severely restricted.

An interface pad circuit configured for conveying an electrical signal from a semiconductor chip component to a component external to the semiconductor chip component, the interface pad circuit includes: a control circuit; a plurality of semiconductor elements, the semiconductor elements having respective bulk terminals and being controlled by the control circuit; and a connection pad; wherein at least two of the semiconductor elements are configured for providing a plurality of non-zero logic voltage levels to the connection pad; and wherein the control circuit is configured to apply a voltage level to the bulk terminals of the at least two of the semiconductor elements providing the non-zero logic voltage levels, the voltage level applied by the control circuit corresponding to the highest voltage level of the plurality of non-zero logic voltage levels.

Optionally, at least one of the semiconductor elements is configured to provide a logic zero voltage level.

Optionally, the control circuit is configured for selectively providing a first non-zero logic voltage or a second non-zero logic voltage to the bulk terminal of one of the semiconductor elements, wherein the first non-zero logic voltage is substantially equal to the logic voltage level provided by the one of the semiconductor elements, and the second non-zero logic voltage is substantially equal to the highest logic voltage level provided by another one of the semiconductor elements.

Optionally, the control circuit is configured to apply the first non-zero logic voltage to the bulk terminal of the one of the semiconductor elements when the one of the semiconductor elements is providing its associated non-zero logic voltage level to the interface pad; and wherein the control circuit is configured to apply the second non-zero logic voltage to the bulk terminal of the one of the semiconductor elements when another one of the semiconductor elements is providing its associated logic voltage level to the interface pad.

Optionally, the voltage level applied by the control circuit is the same or substantially the same as the highest voltage level of the plurality of non-zero logic voltage levels.

Optionally, the interface pad circuit further includes a first switch configured to supply a first bulk biasing voltage to the bulk terminal of one of the semiconductor elements controlled by the control circuit.

Optionally, the interface pad circuit further includes a second switch configured to supply a second bulk biasing voltage to the bulk terminal of the one of the semiconductor elements controlled by the control circuit.

Optionally, a first control signal for the first switch and a second control signal for second switch are mutually exclusive.

Optionally, first switch and the second switch are microelectronic switches embodied in the interface pad circuit.

Optionally, the semiconductor elements comprises one or more MOS transistors.

Optionally, the control circuit has a logic input terminal, a pad level control terminal, and a plurality of output terminals for controlling the semiconductor elements.

Optionally, the control circuit is configured to provide mutually exclusive control signals to the plurality of semiconductor elements.

A method of operating a microelectronic integrated circuit, the microelectronic circuit comprising a plurality of semiconductor elements each providing a logic voltage level, the method includes: providing one of the semiconductor elements with a first bulk biasing voltage or a second bulk biasing voltage, the first bulk biasing voltage being substantially equal to the logic voltage level provided by the one of the semiconductor elements, and the second bulk biasing voltage being substantially equal to the highest logic voltage level provided by another one of the semiconductor elements; wherein the first bulk biasing voltage is provided to the bulk terminal of the one of the semiconductor elements when the one of the semiconductor elements is providing its corresponding logic voltage level; and wherein the second bulk biasing voltage is provided to the bulk terminal of the one of the semiconductor elements when another one of the semiconductor elements is providing its corresponding logic voltage level.

Optionally, the semiconductor elements comprise MOS transistors.

Optionally, the microelectronic integrated circuit is configured for use in a hearing aid.

Other and further aspects and features will be evident from reading the following detailed description.

DESCRIPTION OF THE FIGURES

The disclosure will now be described in further detail with reference to the drawings, where.

DETAILED DESCRIPTION

Figure 1:
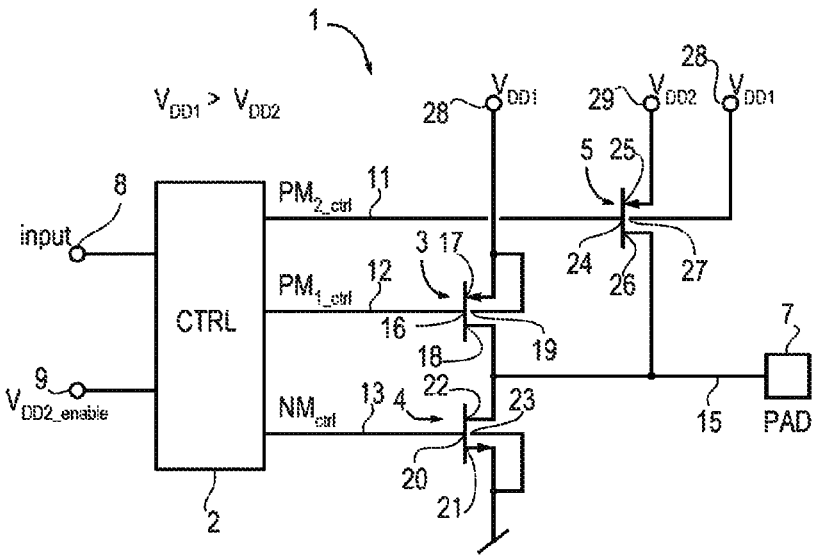
FIG. 1 is an exemplary schematic diagram of an embodiment of an interface pad circuit.

Various features are described hereinafter with reference to the figures. It should be noted that the figures may or may not be drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated or if not so explicitly described.

FIG. 1 is a schematic diagram showing the major parts of an interface pad circuit 1 of a microelectronic chip for a hearing aid according to a first embodiment. The interface pad circuit 1 comprises a control circuit 2, a first PMOS transistor 3, an NMOS transistor 4, a second PMOS transistor 5 and an interface pad 7. The first PMOS transistor 3 comprises a gate terminal 16, a source terminal 17, a drain terminal 18 and a bulk terminal 19, the NMOS transistor 4 comprises a gate terminal 20, a source terminal 21, a drain terminal 22 and a bulk terminal 23, and the second PMOS transistor 5 comprises a gate terminal 24, a source terminal 25, a drain terminal 26 and a bulk terminal 27. The gate 24 of the second PMOS transistor 5 is connected to the control circuit 2 via a first control line 11 carrying the control signal $PM_{2_ctrl}$ (asserted LOW), the gate 16 of the first PMOS transistor 3 is connected to the control circuit 2 via a second control line 12 carrying the control signal $PM_{1_ctrl}$ (asserted LOW), and the gate 20 of the NMOS transistor 4 is connected to the control circuit 2 via a third control line 13 carrying the control signal $NM_{ctrl}$ (asserted HIGH).

The bulk terminal 19 and the source terminal 17 of the first PMOS transistor 3 are connected to a first voltage node 28 carrying a first logic voltage $V_{DD1}$, the bulk terminal 23 and the source terminal 21 of the NMOS transistor 4 are connected to a common node, the source terminal 25 of the second PMOS transistor 5 is connected to a second voltage node 29 carrying a second logic voltage $V_{DD2}$, and the bulk terminal 27 of the second PMOS transistor 5 is also connected to the first voltage node 28. In the circuit in FIG. 1, the voltage $V_{DD1}$ of the first voltage node 28 is larger than the voltage $V_{DD2}$ of the second voltage node 29. The voltage $V_{DD1}$ is thus provided to the bulk terminals of both the first PMOS transistor 3 and the second PMOS transistor 5. The drain 18 of the first PMOS transistor 3, the drain 22 of the NMOS transistor 4 and the drain 26 of the second PMOS transistor 5 are all connected to the interface pad 7 via an interface output line 15. The control circuit 2 also comprises a logic signal input terminal 8 and a $V_{DD2_enable}$ terminal 9 for controlling the behavior of the interface pad circuit 1. The logic signal input terminal 8 of the control circuit 2 receives a logic input signal from other parts of the chip (not shown), the logic input signal being intended for components (not shown) external to the chip via the interface pad 7 as a logic voltage $V_{DD1}$ or $V_{DD2}$, respectively, suitable for driving external components.

The purpose of the interface pad circuit 1 shown in FIG. 1 is to convey digital voltages from the silicon chip comprising the interface pad circuit 1 to adjacent chips on the same substrate in e.g. a hearing aid via electric bondings or wires connected to the interface pad 7. Due to different needs of the external components at various points in the startup procedure of the hearing aid, the interface pad circuit 1 must be capable of delivering digital signaling at different logic levels, i.e. 0 volts, representing a digital "0", and $V_{DD1}$ and $V_{DD2}$, respectively, representing a digital "1" at two different logic levels.

The control circuit 2 outputs three mutually exclusive control signals, $NM_{ctrl}$, $PM_{1_ctrl}$, and $PM_{2_ctrl}$, respectively. If a (positive asserted) control signal $NM_{ctrl}$ from the third control line 13 of the control circuit 2 is received on the gate terminal 20 of the NMOS transistor 4, the voltage level of the interface pad 7 is 0 volts, i.e. a digital "0". If a (negative asserted) control signal $PM_{1_ctrl}$ from the second control line 12 of the control circuit 2 is received on the gate terminal 16 of the first PMOS transistor 3, the voltage level of the interface pad 7 is $V_{DD1}$ volts, i.e. a digital "1" of the higher logic level. When a (negative asserted) control signal $PM_{2_ctrl}$ from the first control line 11 of the control circuit 2 is received on the gate terminal 24 of the second PMOS transistor 5, the voltage level of the interface pad 7 is $V_{DD2}$ volts, i.e. a digital "1" of the lower logic level.

The reason that the bulk terminal 27 of the second PMOS transistor 5 is not connected to the source terminal 25 of the second PMOS transistor 5 in the same manner as the first PMOS transistor 3 and the NMOS transistor 4 is that if the voltage level of the interface pad 7 is above the lower logic level plus the threshold voltage $V_T$ of the second PMOS transistor 5, the intrinsic diode present between the drain terminal 26 and the bulk terminal 27 of the second PMOS transistor 5 would conduct a current even if the gate 24 of the second PMOS transistor 5 was intended to be OFF, leading some of the current delivered by the first voltage node 28 directly to the second voltage node 29 instead, thus wasting power which could otherwise be used to drive the interface pad 7. This would be the case when the first PMOS transistor 3 is ON, since $$V_{DD1} > V_{DD2} \tag{2}$$

and $$\text{PMOS}_1(\text{ON}) \Rightarrow V_{PAD} > V_{DD2} + V_{th} \tag{3}$$

Thus, the drain-bulk diode of the second PMOS transistor 5 would conduct. In order to counteract the problems associated with this configuration, the interface pad circuit 1 of the prior art has the bulk terminal 27 of the second PMOS transistor 5 connected to $V_{DD1}$ instead of $V_{DD2}$.

This configuration does, however, create other problems. Since the voltage $V_{DD1}$ present on the bulk terminal 27 of the second PMOS transistor 5 is higher than the voltage $V_{DD2}$ present on the source terminal 25 of the second PMOS transistor 5 whenever the second PMOS transistor 5 is ON, the threshold voltage $V_T$ of the second PMOS transistor 5 is degraded due to the bulk effect, thus:

$$V_{TB} = V_{T0} + \gamma(\sqrt{V_{SB} + 2\phi_B} - \sqrt{2\phi_B}) \tag{4}$$

Here, $V_{TB}$ is the threshold voltage when a substrate voltage is present, $V_{T0}$ is the value of the threshold voltage when the voltage difference between source and bulk is zero, i.e. $V_{SB}=0$, and $\gamma$ and $\phi_B$ are PMOS device parameters. As may be shown by equation (4), if the bulk potential on a PMOS transistor relative to the source potential on the PMOS transistor goes up, then the threshold voltage $V_{TB}$ also goes up because of the bulk effect. One way to counteract this phenomenon and compensate for the higher ON-resistance $R_{DS}$ resulting from the degraded threshold level is to make the second PMOS transistor 5 physically significantly wider. This has two detrimental effects on the interface pad circuit 1. Firstly, a wider transistor occupies a greater area on the chip, leading to higher production costs, secondly, the resulting increased parasitic capacitance and gate capacitance associated with a physically larger transistor will lead to an increase in dynamic power consumption by the transistor, cf. equation (1).

Figure 2:
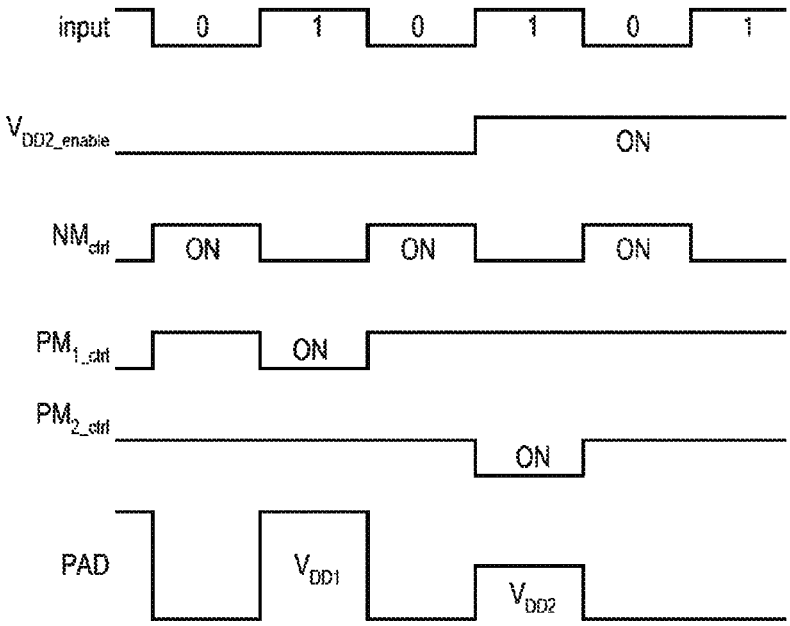
FIG. 2 is a functional timing diagram of the control signals for the embodiment shown in FIG. 1.

FIG. 2 is a functional timing diagram showing significant voltage levels and mutual timings of the interface pad circuit 1 in FIG. 1. First from the top down through the timing diagram is the binary, digital input signal driving the control circuit 2, then the $V_{DD2_enable}$ signal (asserted positive), the control signal $NM_{ctrl}$ for the NMOS transistor 4 (asserted positive), the control signal $PM_{1_ctrl}$ controlling the first PMOS transistor 3 (asserted negative), the control signal $PM_{2_ctrl}$ controlling the second PMOS transistor 5 (asserted negative) and the voltage level present on the interface pad 7. As stated in the foregoing, $V_{DD1}$ is the higher logic "1" output level and $V_{DD2}$ is the lower logic "1" output level of the interface pad 7. In the following, the functional timing diagram is referenced from left to right.

On the first digital "0" from the left in FIG. 2, the NMOS transistor 4 is turned ON and the two PMOS transistors 3 and 5 are both turned OFF. The voltage of the interface pad 7 is zero. On the first digital "1", the NMOS transistor 4 and the second PMOS transistor 5 are both turned OFF, and the first PMOS transistor 3 is turned ON. The voltage level present on the interface pad 7 is $V_{DD1}$ due to the fact that the $V_{DD2_enable}$ signal is still OFF. The second digital "0" has the same effect as the first digital "0". On the second digital "1", however, the $V_{DD2_enable}$ signal is ON, the NMOS transistor 4 and the first PMOS transistor 3 are both OFF, and the second PMOS transistor 5 is ON. The voltage present on the interface pad 7 is therefore $V_{DD2}$. Thus, the interface pad circuit 1 is capable of providing two different, logic "1"-levels for driving external circuitry.

Even though the interface pad circuit 1 of FIG. 1 performs its intended function, it has less-than-ideal performance parameters due to the problems of the bulk voltage potential on the bulk terminal 27 of the second PMOS transistor 5 being higher than the voltage potential on the source terminal 25 of the second PMOS transistor 5, as discussed in the foregoing. A more effective and optimized design for an interface pad circuit for a microelectronic circuit is described in the following.

Figure 3:
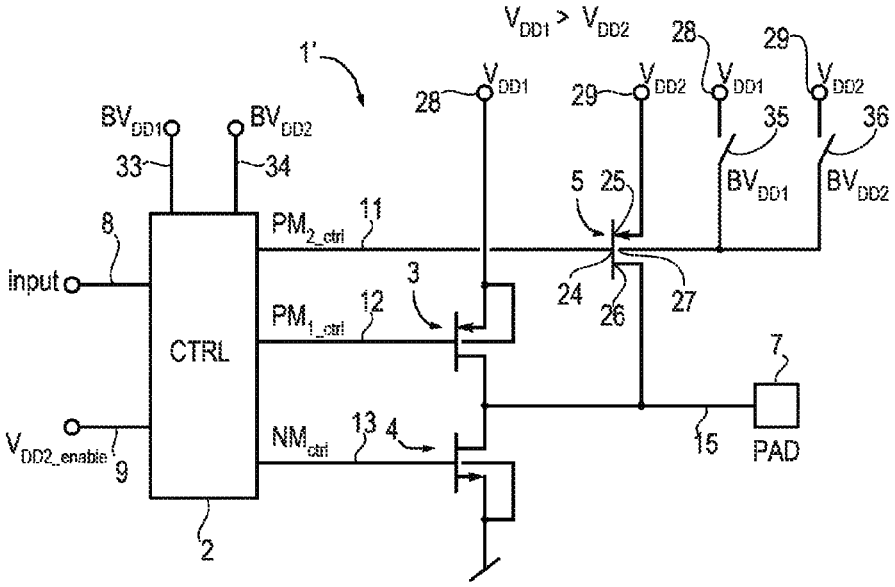
FIG. 3 is an exemplary schematic diagram of an alternative embodiment of an interface pad circuit with controlled bulk voltage connections.

An alternative design for an interface pad circuit 1' is disclosed in FIG. 3. The interface pad circuit 1' shown in FIG. 3 has features similar to the circuit 1 of FIG. 1 apart from the following features: The control circuit 2 has a first bulk biasing control terminal 33 and a second bulk biasing control terminal 34 for controlling the bulk biasing voltage level delivered to the bulk terminal 27 of the second PMOS transistor 5. The first bulk biasing control terminal 33 carries the signal $BV_{DD1}$ and the second bulk biasing control terminal 34 carries the signal $BV_{DD2}$. The higher bulk biasing voltage $V_{DD1}$ is applied to the bulk terminal 27 of the second PMOS transistor 5 via a first voltage-controlled switch 35 controlled by the signal from the first bulk biasing control terminal 33, and the lower bulk biasing voltage $V_{DD2}$ is applied to the bulk terminal 27 of the second PMOS transistor 5 via a second voltage-controlled switch 36 controlled by the signal from the second bulk biasing control terminal 34. The voltage-controlled switches 35 and 36 are shown in FIG. 3 as plain switches for clarity, but are in fact embodied on-chip as MOS transistors controlled by the control circuit 2. The signals $BV_{DD1}$ and $BV_{DD2}$ from the bulk biasing control terminals 33 and 34 of the control circuit 2 are mutually exclusive.

The effect of this embodiment is that it is possible to control the bulk biasing voltage level applied to the bulk terminal 27 of the second PMOS transistor 5 of the interface pad circuit 1' in a convenient and simple manner. By controlling the bulk biasing voltage level applied to the bulk terminal 27 of the second PMOS transistor 5, several benefits are obtained. One benefit is that the problem with the drain-bulk diode of the second PMOS transistor 5 conducting unintentionally is eliminated completely, since the voltage potential of the output pad 7 is never allowed to exceed the voltage potential present on the bulk terminal 27 of the second PMOS transistor 5, and the condition of equation (3) is therefore not fulfilled. Another benefit is that the degradation of the threshold voltage $V_T$ of the second PMOS transistor 5 is also eliminated, since the voltage potential on the bulk terminal 27 of the second PMOS transistor 5 is now higher than the voltage potential on the source terminal 25 only when the second PMOS transistor 5 is OFF, and equal to the voltage potential on the source terminal 25 when the second PMOS transistor 5 is ON. In fact, this permits the second PMOS transistor 5 to be made considerably smaller physically, thus reducing the area on the chip occupied by the semiconductor device, consequently reducing the corresponding capacitance of the second PMOS transistor 5, which in turn reduces the dynamic power consumed by the device, thus saving energy.

Figure 4:
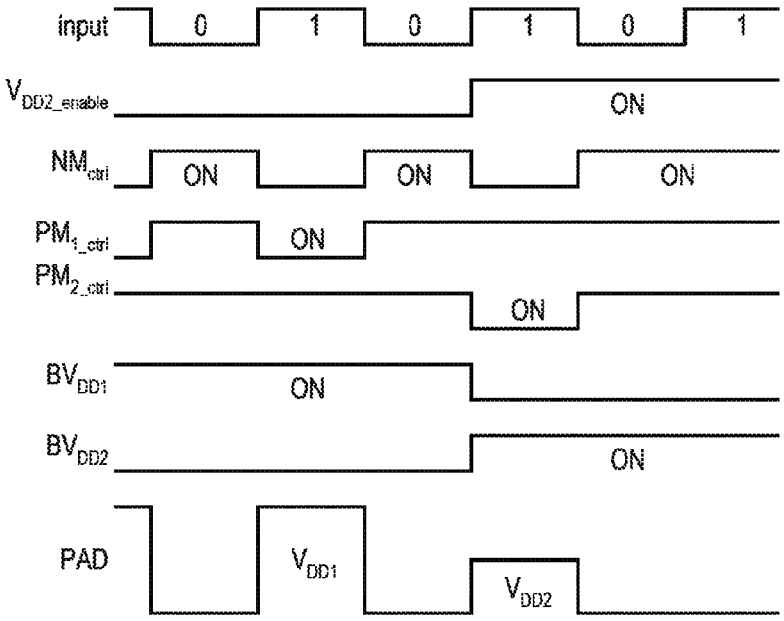
FIG. 4 is a functional timing diagram of the control signals for the embodiment shown in FIG. 3.

FIG. 4 is a functional timing diagram showing voltage levels and mutual timings of the interface pad circuit 1' in FIG. 3. The timing diagram in FIG. 4 is similar to the timing diagram shown in FIG. 2 apart from the fact that timings for the control signals of bulk biasing voltages $BV_{DD1}$ and $BV_{DD2}$ are also shown in FIG. 4. The control signal for the low bulk biasing voltage terminal $BV_{DD2}$ follows the control signal $V_{DD2_enable}$ closely, and the control signal $BV_{DD1}$ is complementary of that, being OFF whenever the control signal $BV_{DD2}$ is ON, and vice versa. In other words, when the high logic "1" voltage level is used, the high bulk biasing voltage $V_{DD1}$ is provided to the bulk terminal 27 of the second PMOS transistor 5, and when the low logic "1" voltage level is used, the low bulk biasing voltage $V_{DD2}$ is provided to the bulk terminal 27 of the second PMOS transistor 5.

In one embodiment, the physical size of the second PMOS transistor 5 in the interface pad circuit 1' may be reduced on the chip to about 6-7% of the size of the second PMOS transistor 5 in the interface pad circuit 1 without compromising on the ON-resistance $R_{DS}$. If a hearing aid chip comprises e.g. four interface pads of the kind shown in FIG. 3 for connection to other circuits, this configuration contributes considerably to the smaller size, higher efficiency and low current consumption of the whole chip. In typical embodiments, there may be eight or more interface pads available on-chip without an excessive amount of power being drawn by the circuit.

Figure 5:
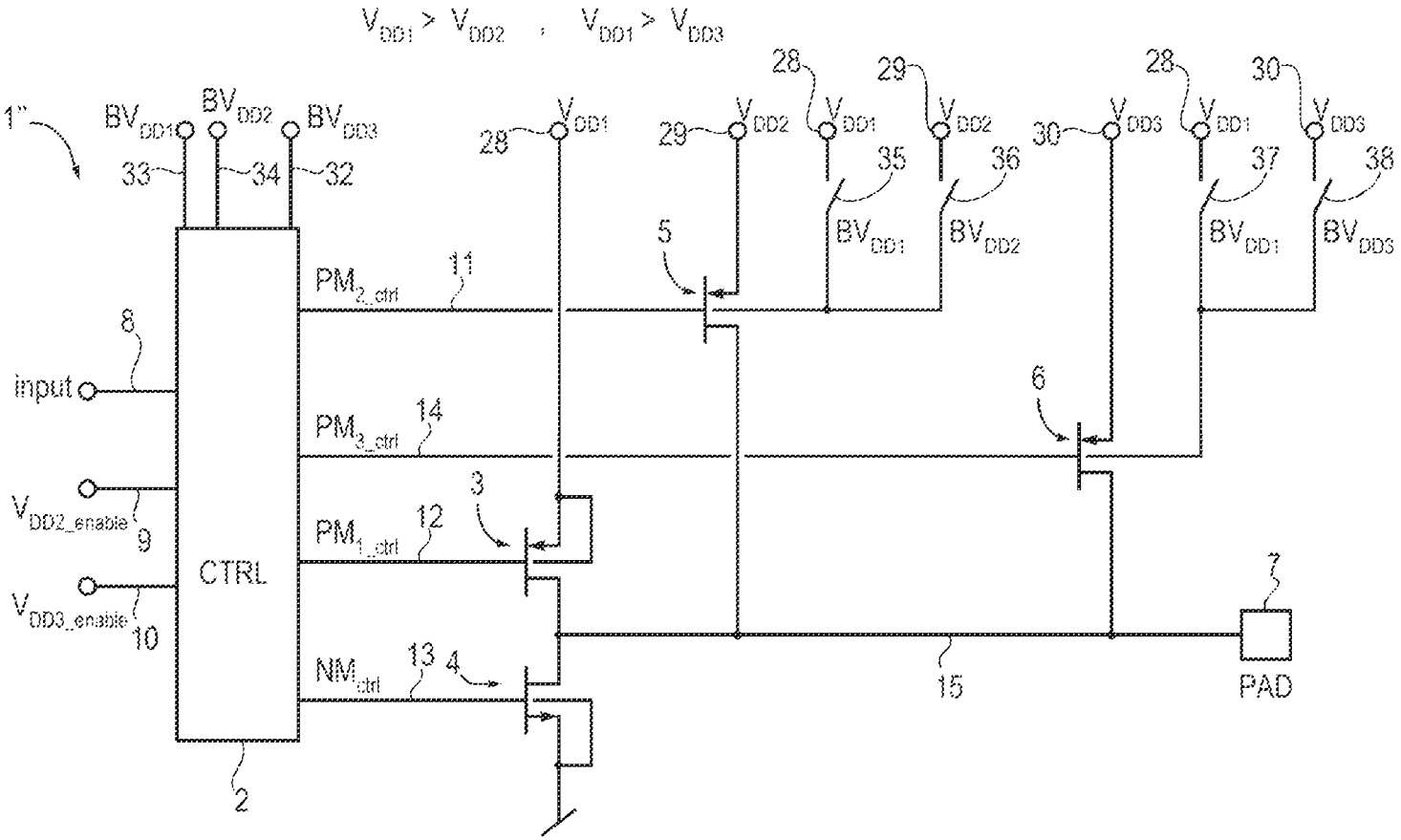
FIG. 5 is a schematic diagram of an embodiment of an interface pad circuit capable of handing three different logic voltage levels.

In another alternative embodiment, the interface pad circuit may be capable of driving external components at three or more different logic voltage levels all selected by the control circuit 2. One such embodiment is shown in FIG. 5, where an interface pad circuit 1" further has a third PMOS transistor 6 providing a logic voltage $V_{DD3}$ to the interface pad 7 via a third voltage node 30. In other respects, the interface pad circuit 1" has features similar to the interface pad circuit 1' shown in FIG. 3. Both the voltage level $V_{DD2}$ and the voltage level $V_{DD3}$ are lower than the voltage level $V_{DD1}$. The third PMOS transistor 6 is controlled by the control circuit 2 via a fourth control line 14 providing the control signal $PM_{3_ctrl}$. A bulk terminal of the third PMOS transistor 6 is connected to a node shared by a third voltage-controlled switch 37 and a fourth voltage-controlled switch 38. The control circuit 2 further has a $V_{DD3_enable}$ input terminal 10 for controlling the provision of the logic voltage $V_{DD3}$ to the interface pad 7 and a control terminal 32 carrying the control signal $B_{VDD3}$ for controlling the fourth voltage-controlled switch 38. The purpose of the fourth voltage-controlled switch 38 is to provide the logic voltage $V_{DD3}$ to the bulk terminal of the third PMOS transistor 6 whenever the logic output voltage $V_{DD3}$ is to be utilized by the interface pad 7. The purpose of the third voltage-controlled switch 37 is to provide the highest logic voltage $V_{DD1}$ to the bulk terminal 31 of the third PMOS transistor 6 whenever either $V_{DD1}$ or $V_{DD2}$ is utilized by the interface pad 7.

When the logic output voltage $V_{DD1}$ is provided by the interface pad 7, the first PMOS transistor 3 is activated by the control circuit 2 via the second control line 12. In this case, the bulk biasing voltage on the bulk terminal of the second PMOS transistor 5 and the third PMOS transistor 6, respectively, is set to $V_{DD1}$, i.e. the highest bulk biasing voltage, by closing the first voltage-controlled switch 35 and the third voltage-controlled switch 37.

When $V_{DD2}$ is provided by the interface pad 7, the second PMOS transistor 5 is activated by the control circuit 2 via the first control line 11. In this case, the bulk biasing voltage on the bulk terminal of the third PMOS transistor 6 is set to $V_{DD1}$ by closing the third voltage-controlled switch 37, and the bulk biasing voltage on the bulk terminal of the second PMOS transistor 5 is set to $V_{DD2}$ by closing the second voltage-controlled switch 36.

When $V_{DD3}$ is provided by the interface pad 7, the third PMOS transistor 6 is activated by the control circuit 2 via the fourth control line 14. In this case, the bulk biasing voltage on the bulk terminal of the second PMOS transistor 5 is set to $V_{DD1}$ by closing the first voltage-controlled switch 35, and the bulk biasing voltage on the bulk terminal of the third PMOS transistor 6 is set to $V_{DD3}$ by closing the second voltage-controlled switch 38.

In another embodiment, the interface pad circuit comprises a plurality n of PMOS transistors being adapted for providing one of n corresponding logic voltage levels $V_{DDn}$ to the interface pad 7. The control circuit 2 is then adapted for applying the highest bulk biasing voltage $V_{DD1}$ to the bulk terminals of each of the n PMOS transistors if another logic voltage level than the logic voltage level $V_{DDn}$ supplied by the n'th PMOS transistor is provided to the interface pad 7, and applying the bulk biasing voltage $V_{DDn}$ to the bulk terminal of the n'th PMOS transistor if the logic voltage level $V_{DDn}$ is supplied.

A simple and effective design for an interface pad circuit for an electronic circuit, such as a microelectronic circuit for use in a hearing aid, may hereby be realized. Although the interface pad circuit is described herein with reference to specific configurations and embodiments, the interface pad circuit is by no means limited to these embodiments but may be realized in many other ways without deviating from the limitations provided by the claims.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. An interface pad circuit configured for conveying an electrical signal from a semiconductor chip component to a component external to the semiconductor chip component, the interface pad circuit comprising:

a control circuit;

a plurality of semiconductor elements, the semiconductor elements having respective bulk terminals and being controlled by the control circuit; and a connection pad;

wherein at least two of the semiconductor elements are configured for providing a plurality of non-zero logic voltage levels to the connection pad; and wherein the control circuit is configured to apply a voltage level to the bulk terminals of the at least two of the semiconductor elements providing the non-zero logic voltage levels, the voltage level applied by the control circuit corresponding to the highest voltage level of the plurality of non-zero logic voltage levels.

2. The interface pad circuit according to claim 1, wherein at least one of the semiconductor elements is configured to provide a logic zero voltage level.

3. The interface pad circuit according to claim 1, wherein the control circuit is configured for selectively providing a first non-zero logic voltage or a second non-zero logic voltage to the bulk terminal of one of the semiconductor elements, wherein the first non-zero logic voltage is substantially equal to the logic voltage level provided by the one of the semiconductor elements, and the second non-zero logic voltage is substantially equal to the highest logic voltage level provided by another one of the semiconductor elements.

4. The interface pad circuit according to claim 3, wherein the control circuit is configured to apply the first non-zero logic voltage to the bulk terminal of the one of the semiconductor elements when the one of the semiconductor elements is providing its associated non-zero logic voltage level to the interface pad; and wherein the control circuit is configured to apply the second non-zero logic voltage to the bulk terminal of the one of the semiconductor elements when another one of the semiconductor elements is providing its associated logic voltage level to the interface pad.

5. The interface pad circuit according to claim 1, wherein the voltage level applied by the control circuit is the same or substantially the same as the highest voltage level of the plurality of non-zero logic voltage levels.

6. The interface pad circuit according to claim 1, further comprising a first switch configured to supply a first bulk biasing voltage to the bulk terminal of one of the semiconductor elements controlled by the control circuit.

7. The interface pad circuit according to claim 6, further comprising a second switch configured to supply a second bulk biasing voltage to the bulk terminal of the one of the semiconductor elements controlled by the control circuit.

8. The interface pad circuit according to claim 7, wherein a first control signal for the first switch and a second control signal for second switch are mutually exclusive.

9. The interface pad circuit according to claim 7, wherein first switch and the second switch are microelectronic switches embodied in the interface pad circuit.

10. The interface pad circuit according to claim 1, wherein the semiconductor elements comprises one or more MOS transistors.

11. The interface pad circuit according to claim 1, wherein the control circuit has a logic input terminal, a pad level control terminal, and a plurality of output terminals for controlling the semiconductor elements.

12. The interface pad circuit according to claim 1, wherein the control circuit is configured to provide mutually exclusive control signals to the plurality of semiconductor elements.

13. A method of operating a microelectronic integrated circuit, the microelectronic circuit comprising a plurality of semiconductor elements each providing a logic voltage level, the method comprising:

providing one of the semiconductor elements with a first bulk biasing voltage or a second bulk biasing voltage, the first bulk biasing voltage being substantially equal to the logic voltage level provided by the one of the semiconductor elements, and the second bulk biasing voltage being substantially equal to the highest logic voltage level provided by another one of the semiconductor elements;

wherein the first bulk biasing voltage is provided to the bulk terminal of the one of the semiconductor elements when the one of the semiconductor elements is providing its corresponding logic voltage level; and wherein the second bulk biasing voltage is provided to the bulk terminal of the one of the semiconductor elements when another one of the semiconductor elements is providing its corresponding logic voltage level.

14. The method according to claim 13, wherein the semiconductor elements comprise MOS transistors.

15. The method according to claim 13, wherein the microelectronic integrated circuit is configured for use in a hearing aid.

* * * * *